United States Patent [19]

Kimura et al.

[11] Patent Number: 4,859,152

[45] Date of Patent: Aug. 22, 1989

[54] ELECTROMAGNETIC AIR PUMP

[75] Inventors: Rokusaburo Kimura, Kobe; Yoshie Watari, Osaka; Satoshi Makayama, Nara, all of Japan

[73] Assignee: Matsushita Electric Works, Ltd., Osaka, Japan

[21] Appl. No.: 122,464

[22] Filed: Nov. 19, 1987

[30] Foreign Application Priority Data

Nov. 26, 1986 [JP] Japan ..... 61-281433

[51] Int. Cl.[4] ..... F04B 39/12; F04B 45/04

[52] U.S. Cl. ..... 417/63; 417/360; 417/418

[58] Field of Search ..... 417/413, 415, 416, 417, 417/418, 366, 371, DIG. 1; 310/15, 16, 17, 23, 30, 34; 92/100, 103 F; 467/360, 63

[56] References Cited

U.S. PATENT DOCUMENTS

| | | | |
|---|---|---|---|
| 3,515,966 | 6/1970 | De Valroger | 310/17 X |
| 3,606,592 | 9/1971 | Madurski et al. | 92/103 F X |
| 3,825,374 | 7/1974 | Kondo | 417/413 |
| 3,931,554 | 1/1976 | Spentzas | 417/418 X |
| 4,090,816 | 5/1978 | Takahashi . | |
| 4,198,743 | 4/1980 | Stuber | 310/30 X |
| 4,495,947 | 1/1985 | Motyeka | 417/413 X |
| 4,505,450 | 3/1985 | Saarem et al. | 92/103 F X |
| 4,608,000 | 8/1986 | Tominaga | 417/413 |
| 4,697,674 | 10/1987 | Tangorra | 92/103 F X |

FOREIGN PATENT DOCUMENTS

| | | | |
|---|---|---|---|
| 55-125379 | 9/1980 | Japan | 417/418 |
| 62-70673 | 4/1987 | Japan . | |

*Primary Examiner*—Carlton R. Croyle
*Assistant Examiner*—Eugene L. Szczecina, Jr.
*Attorney, Agent, or Firm*—Burns, Doane, Swecker & Mathis

[57] ABSTRACT

An air pump includes a housing body containing an electromagnetic drive mechanism for oscillating a pair of diaphragms. The diaphragms define variable volume chambers, the chambers communicating with suction and discharge ports for establishing an air flow in response to diaphragm oscillation. The drive mechanism comprises coils defining an air gap and a permanent magnet type actuator reciprocably mounted in the air gap. The top of the housing body is open to enable the actuator to be visually inspected for proper alignment within the air gap. A cover is installed over the open top of the housing body with the actuator properly installed in the air gap. The cover contains air passages communicating with the suction and discharge ports. The weight of the diaphragm can be altered to achieve a desired resonance frequency tuned to the frequency of the electrical current.

10 Claims, 5 Drawing Sheets

Fig. 4
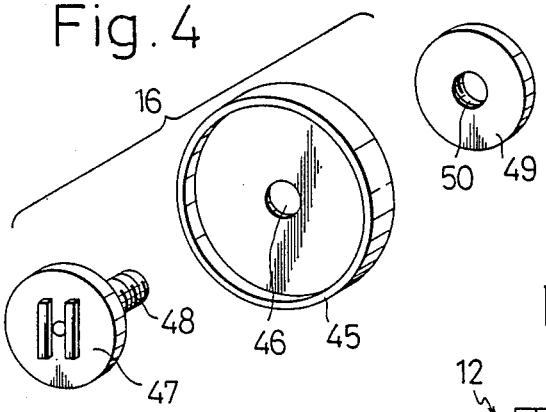
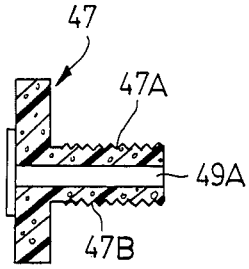
Fig. 12
Fig. 6
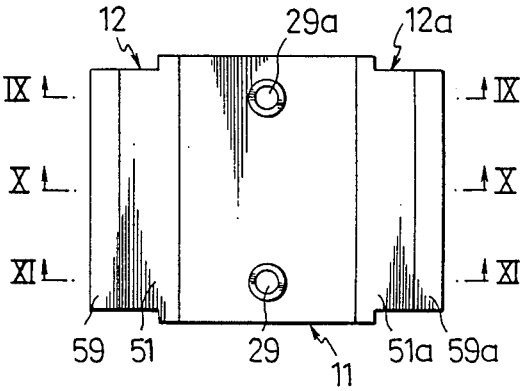
Fig. 8
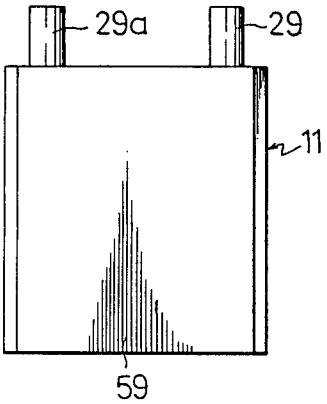
Fig. 7
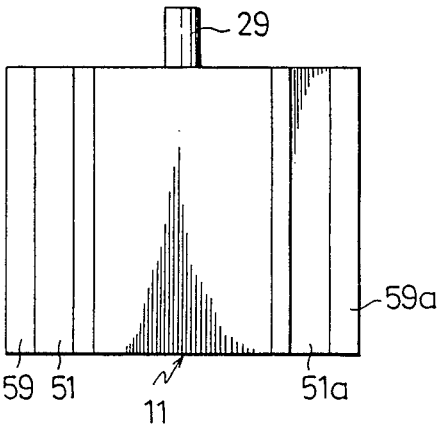

ELECTROMAGNETIC AIR PUMP

BACKGROUND ART OF THE INVENTION

This invention relates to electromagnetic air pumps in which an actuator is electromagnetically driven in reciprocating motion, a diaphragm is mounted to each end of the actuator in the direction of the reciprocating motion so as to define a part of a variable volume chamber positioned at such each end of the actuator, and the volume of this chamber is varied accompanying the reciprocating motion of the actuator to supply air.

DISCLOSURE OF PRIOR ART

U.S. Pat. No. 4,090,816 to S. Takahashi discloses an air compressor type fluid actuating device in which an actuator is provided in a sealed casing to be shiftable in an axial direction by an electromagnetic force as well as a spring load so that the volume of a variable volume chamber defined at an end of the actuator will be increased and decreased responsive to the axial shift of the actuator.

Further, U.S. Pat. No. 3,825,374 to R. Kondo discloses an air supply device wherein a vibrating arm is electromagnetically driven for reciprocating vibration. A diaphragm coupled to the vibrating arm is made to define a part of a variable volume chamber, the volume of this chamber being increased and decreased in response to the vibration of the arm to cause suction and discharge valves of the chamber to be opened and closed to supply air.

In Japanese Patent Application No. 60-211301 (laid-open under No. 62-70673) of T. Maruyama et al including the present inventors, there has been suggested an air supply device in which an actuator is electromagnetically driven to axially reciprocate. A pair of diaphragms are coupled to axial ends of the actuator so as to have a pair of variable volume chambers partly defined by these diaphragms at the ends of the actuator, and the volume of these chambers is thereby increased and decreased in response to the reciprocation of the actuator to open and close suction and discharge valves for supplying air.

In all of these prior art, however, there have been such drawbacks that the actuator or vibrating member cannot be assembled with other components of the device in a state in which the positioning of the actuator is carried out while directly visually confirming the position of the actuator relative to an air gap for achieving maximum accuracy. Also, the required parts for electromagnetic assembly including the actuator have been so large as to render the assembly work to be complicated and time-consuming.

TECHNICAL FIELD

An object of the present invention is, therefore, to provide an electromagnetic air pump capable of allowing the position of the actuator being assembled to be directly visually confirmed for a highly precise assembling of the actuator into the device, while simplifying the structure to reduce the required numbers of parts and to improve the assembling ability.

According to the present invention, this object can be realized by providing an electromagnetic air pump comprising a core block including an iron core and exciting coils would on the core with an air gap maintained, an actuator having a permanent magnet and inserted into the air gap, a diaphragm means mounted to axial ends of the actuator to flex in a plane perpendicular to the shifting direction of the actuator, variable volume chambers defined inside a housing in which the core block is disposed, the diaphragm means defining part of the chambers, and suction and discharge valve means associated with the variable volume chambers for being opened and closed in response to the shifting of the actuator. A body constituting a main part of the housing and directly accommodating therein the core block is of box-shape and opened at the top face, a cover member is fitted to the opened top face of the body, and means for supporting the diaphragm means is provided to the body in opposing walls of the body in the shifting direction of the actuator.

BRIEF EXPLANATION OF THE DRAWINGS

Other objects and advantages of the present invention will be made clear in the following explanation of the invention detailed with reference to an embodiment shown in accompanying drawings.

FIG. 4 is a perspective view as disassembled of a diaphragm in the pump of FIG. 1;

FIG. 6 is a top plan view as assembled of the pump of FIG. 1;

FIG. 7 is a side view as assembled of the pump of FIG. 1;

FIG. 8 is a front view as assembled of the pump of FIG. 1;

FIG. 12 is a longitudinal sectional view taken through one of the center plates.

While the present invention is explained with reference to the embodiment shown in the accompanying drawings, it should be appreciated that the intention is not limited invention only to the embodiment shown, but rather includes all modifications, alterations and equivalent arrangements possible within the scope of appended claims.

DISCLOSURE OF PREFERRED EMBODIMENT

Figure 1:
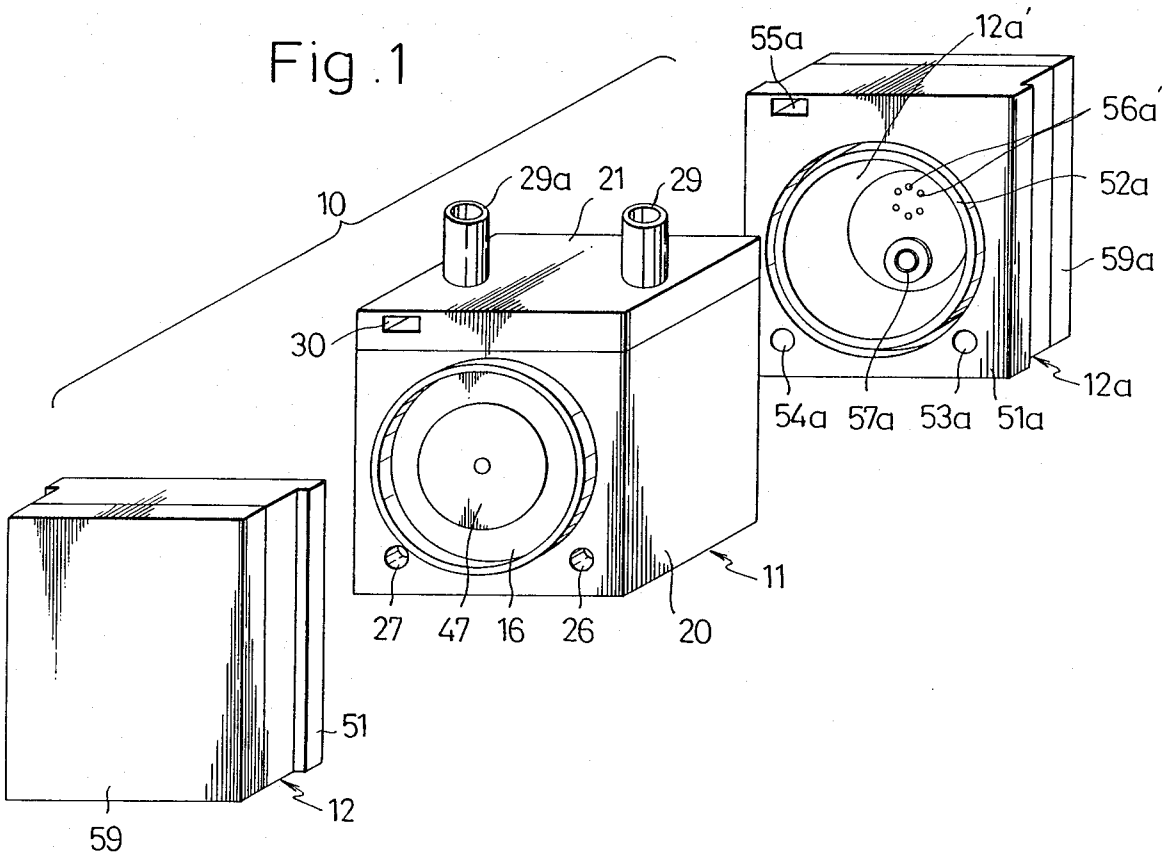
FIG. 1 is a perspective view as disassembled of an electromagnetic air pump according to the present invention.
Figure 2:
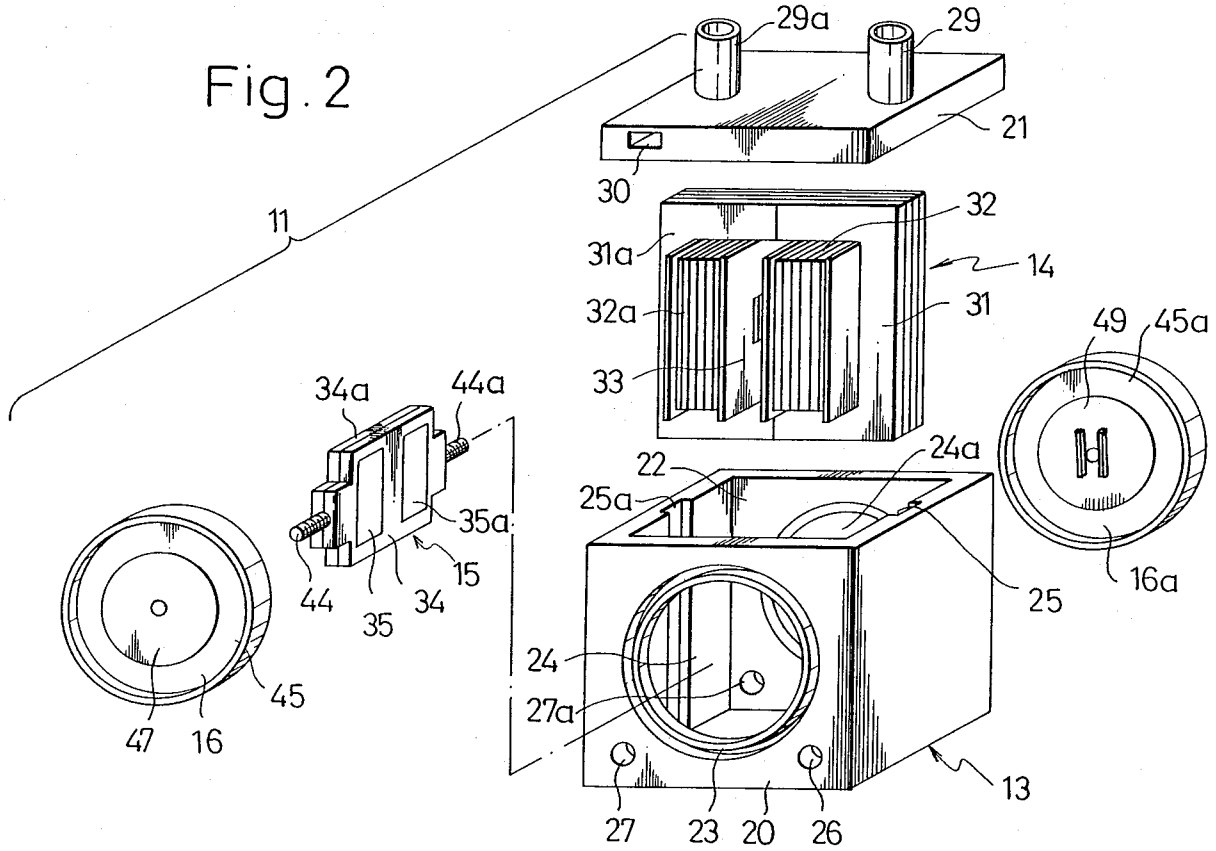
FIG. 2 is a perspective view as disassembled of a body and a core block housed in the body in the pump of FIG. 1.

Referring to FIGS. 1 and 2, an electromagnetic pump 10 according to the present invention includes a main body assembly 11 and end wall members 12 and **12*a* fitted respectively to the ends of the main body assembly 11, the latter of which includes a body 13 box-shaped and opened at the upper side, a core block 14 accommodated in the body 13, an actuator 15 inserted in the core block 14, and circular diaphragm means 16 and 16*a*. The body 13 is constituted by a box-shaped member 20, a top opening 22 of which is closed by a cover member 21, and a housing of the pump 10 is formed by the box-shaped member 20, cover member and end wall members 12 and 12***a*.

The box-shaped member 20 is provided with external annular grooves 23 and 23*a* made in outer surfaces of opposing first walls of the member 20 (only one of which grooves can be seen in the drawings) and with coaxial round holes 24 and 24*a* disposed inside the grooves 23 and 23*a*. When the diaphragm means 16 and 16*a* are fitted into these holes 24 and 24*a*, peripheral parts of the circular diaphragm means 16 and 16*a* will be engaged in the annular grooves 23 and 23*a* so as to tension the diaphragm mans. Substantially in the center of opposing second side walls of the box-shaped member 20, vertically extended engaging internal grooves 25 and 25*a* are formed for receiving edges of the core bock 14 which is positioned in the center of the box-shaped member 20. Conduits 26, 26*a* and 27, 27*a* forming respectively part of an air path are made in lower corner parts of the opposing first wall.

The core block 14 comprises E-shaped cores 31 and 31*a*, and exciting coils 32 and 32*a* wound on central legs of these E-shaped cores so as to oppose each other through a central air gap 33. The block 14 is assembled into the box-shaped member 20 by engaging base end edges of the E-shaped cores 31 and 31*a* into the vertical engaging grooves 25 and 25*a* in the inner side wall surfaces of the member 20. The actuator 15 is provided for disposition horizontally at the center of the air gap 33 of the core block 14. In the present instance, the actuator 15 has, as specifically shown in FIG. 3, a pair of frame halves 34 and 34*a* formed to hold between them a pair of permanent magnets 35 and 35*a* which are received in two pairs of aligned recesses 36, 37 and 36*a*, 37*a* formed in the frame halves 34 and 34*a* when they are fitted to each other. Further, the frame halves 34 and 34*a* are respectively so formed that the frame half 34 has holes 38 and 38*a* at diagonally opposed corners and inward projections 39 and 39*a* at the other corners. The other frame half 34*a* is provided with inward projections 40 and 40*a* for engaging in the holes 38 and 38*a* of the frame half 34, and with holes 41 and 41*a* for receiving allowing the projections 39 and 39*a* of the frame half 34. In longitudinal end edges of the both frame halves 34 and 34*a*, there are formed a pair of recesses 42, 43 and 42*a*, 43*a* which constitute link-pin bearings when the halves are fitted to each other. Upon fitting the two frame halves 34 and 34*a* to each other, with the respective inward projections engaged in the respective holes, therefore, the permanent magnets 35 and 35*a* are held between the thus-fastened frame halves, and link pins 44 and 44*a* are fixed as held in the recesses 42, 43 and 42*a*, 43*a*, whereby the permanent magnets 35 and 35*a* are assembled in the actuator 15 without requiring any adhesive agent and the assembling ability is made excellent. The frame halves 34 and 34*a* may advantageously be made of a plastics material, since in that event it is possible to prevent a risk of the permanent magnets 35 and 35*a* are being deteriorated by a temperature rise due to the Joule's heat as would otherwise occur if the actuator body or its frame halves were instead made of a metal material, when the eddy current generated by the passing of magnetic force lines through the recesses 36, 37 and 36*a*, 37*a* as a result of an alternating magnetic field.

The pair of diaphragm means 16 and 16*a* are identical, and only one 16 of them shall be explained referring also to FIG. 4 which shows the diaphragm means 16. That is, the diaphragm means 16 comprises a rubber diaphragm 45 having a central hole 46, a first center plate 47 having an axial coupling projection 48, and a second center plate 49 having a central through hole 50. The first center plate 47 is fitted to one side of the rubber diaphragm 45 with the projection 48 passed through the central hole 46 of the diaphragm 45 and through the central hole 50 of the second center plate 49 fitted to the other side of the diaphragm 45 and fixed to the projection 48. The center plates 47 and 48 should preferably be formed with a resin 47*a* which weight is increased by mixing therewith a metal 47*b* as dipicted in FIG. 12.

In assembling the actuator 15 into the body assembly 11, the actuator 15 is inserted, through the hole 24 or 24*a* of the body 13, into the air gap 33 of the core block 14 fitted in the body 13, while visually confirming the position through the top opening 22 of the body 13. The diaphragm means 16 and 16*a* are fitted to the holes 24 and 24*a* while passing the link pins 44 and 44*a* of the actuator 15 through axial holes 49*a* of the projection 48 and calking tip ends of the pins 44 and 44*a* projecting out of the diaphragm means onto outer surfaces of the both means to couple the actuator 15 and diaphragm means 16 and 16*a*. Thus, the actuator 15 can be assembled into the body assembly 11 while sufficiently affirming the position inside the air gap 33 of the core block 14. Accordingly, the disposition accuracy of the actuator 15 can be remarkably improved as compared with any known structure which does not allow the visual confirmation of the positioning to be realized. In the present instance, the actuator 15 is supported resiliently by the diaphragm means 16 and 16*a* for reciprocation in the longitudinal direction of the actuator 15, while the permanent magnets 35 and 35*a* in the actuator 15 are disposed to take mutually symmetrical positions in the longitudinal direction of the actuator with respect to the central poles formed by the relatively short legs of iron cores 31 and 31*a* forming the E-shaped core block 14. The permanent magnets 35 and 35*a* are also disposed to be mutually opposite in their polarity so that, when an alternating current is fed to the exciting coils 32 and 32*a* which are connected in parallel with each other, the actuator 15 will so attracted as to shift in one longitudinal direction of the actuator 15 during each positive half cycle of the alternating current and in the other longitudinal direction during each negative half cycle.

Figure 3:
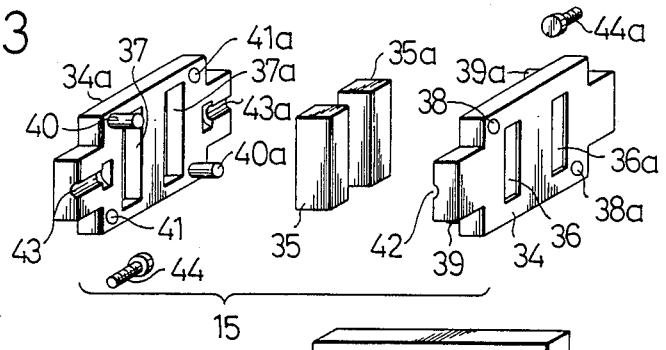
FIG. 3 is a perspective view as disassembled of an actuator in the pump of FIG. 1.
Figure 9:
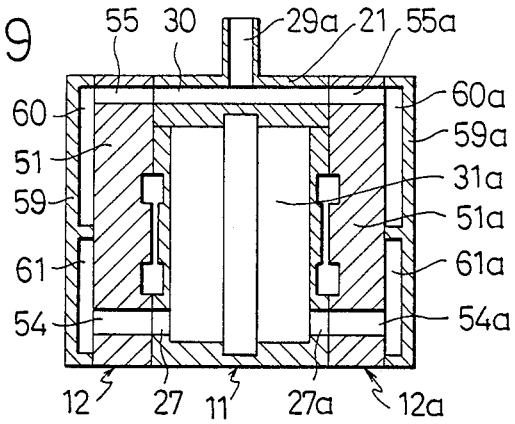
FIG. 9 is a sectioned view of the pump of FIG. 1 taken along line IX—IX in FIG. 6.
Figure 10:
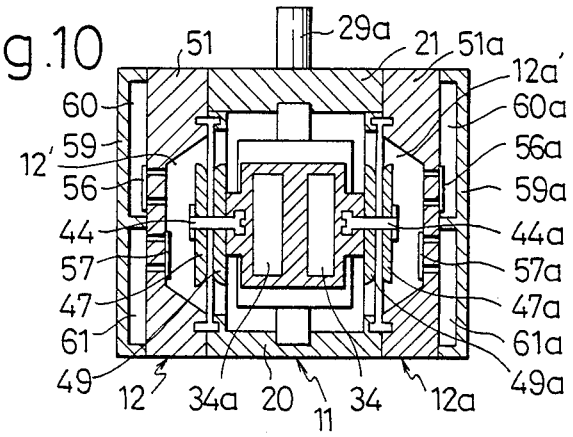
FIG. 10 is a sectioned view of the pump of FIG. 1 taken along line X—X in FIG. 6.
Figure 11:
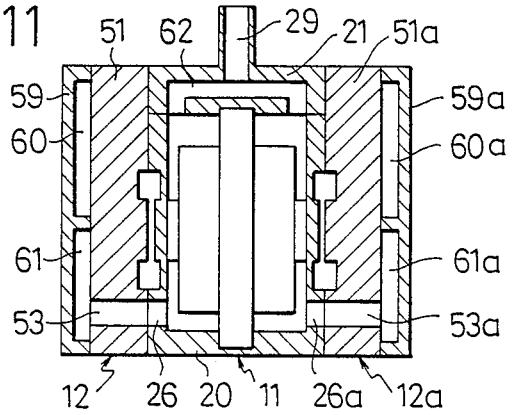
FIG. 11 is a sectioned view of the pump of FIG. 1 taken along line XI—XI in FIG. 6.

After inserting and positioning the core block 14 with the actuator 15 in the body 13, the cover member 21 is fitted to the top opening 22 of the body 13 and the opening 22 is thereby closed. In the cover member 21, there are provided an upward open suction port 29 and a discharge port 29*a*, and a conduit 62 opened at a lower surface of the cover member 21, that is, to the interior of the body 13. The conduit 62 functions to communicate that interior with the suction port 29 (see FIG. 11). A conduit 30 is also provided in the cover member 21 and is arranged to open at both end walls of the member while communicating with the discharge port 29*a* (FIGS. 1, 3 and 9).

Figure 5:
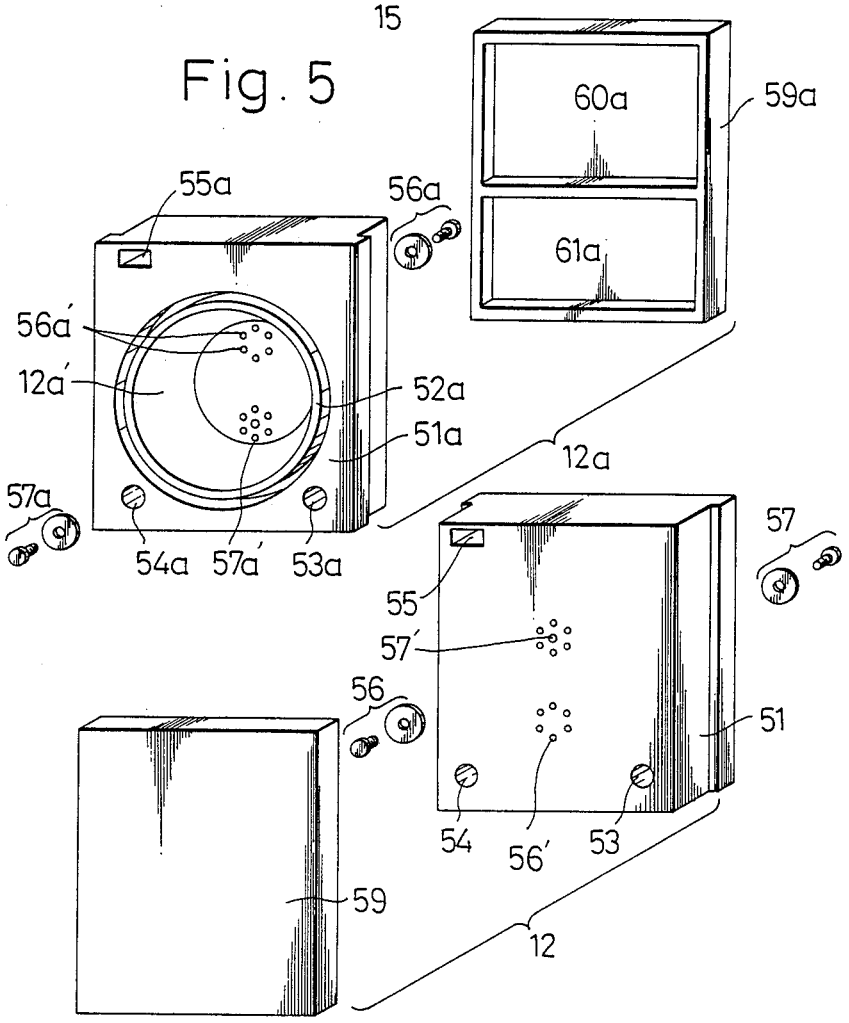
FIG. 5 is a perspective view as disassembled of end wall members in the pump of FIG. 1.

As will be clear in view of FIGS. 6 through 11, the end wall members 12 and 12*a* are respectively provided with compression-chamber parts 51 and 51*a* which are formed to define compression chambers 12' and 12*a'* on the inner side facing the body 13 in association with the diaphragm means 16 and 16*a*, when the members 12 and 12*a* are fitted to the body 13. In the outer end wall of each of the compression-chamber parts 51 and 51*a*, there are provided two vertically separated groups of discharge holes 56' or 56*a'* and suction holes 57' or 57*a'*, and a discharge valve means 56 or 56*a* and a suction valve means 57 or 57*a* are mounted over the respective groups of the holes from the outer and inner sides of the end wall, as seen best in FIGS. 1, 5 and 10. Provided in lower corner portions of the compression-chamber parts 51 and 51*a* are conduits 53, 53*a* and 54, 54*a* aligned with the conduits 26, 26*a* and 27, 27*a* in the box-shaped member 20 and constituting respective portions of the air path. In one of the upper corner portions of these parts 51 and 51*a* there are provided conduction paths 55 and 55*a* aligned with the conduit 30 which communicating with the discharge port 29*a* in the cover member 21 and also constituting portions of the air path.

The end wall members 12 and 12*a* also include end wall covers 59 and 59*a* fitted to outer end faces of the compression-chamber members 51 and 51*a*. On inner sides of these covers 59 and 59*a*, there are provided discharge chambers 60 and 60*a* and suction chambers 61 and 61*a*, the respective discharge and suction chambers in each of the end wall covers 59 and 59*a* being defined in the same vertical relationship as the discharge and suction ports.

Referring now to the operation of the electromagnetic air pump according to the present invention, an alternating current is fed to the exciting coils 32 and 32*a*, and then the actuator 15 born by the diaphragm means 16 and 16*a* starts its reciprocating oscillation. Since the diaphragm means 16 and 16*a* bearing the actuator 15 are provided on both sides of the rubber diaphragm with the center plates 47 and 49 which function to secure the link pins 44 and 44*a* of the actuator and also to provide to the diaphragm a certain weight as being made of, for example, a metal, the diaphragm means, likely to become high in the resonance frequency when the resiliency is high, are made to have an optimum mass of the rubber diaphragm 45 and thus are caused to perform a reciprocating oscillation close to the frequency of the alternating current. In other words, the center plates 47 and 49 providing the mass are effective to perform not only the coupling function with the link pins 44 and 44*a* of the actuator 15 but also a function of adjusting the resonance frequency of the diaphragm without increasing required parts number, so that noise generation and the like problems can be effectively prevented.

Accompanying the reciprocating oscillation of the actuator 15, air is sucked through the suction port 29 in the top face of the cover member 21 into the interior of the member, upon which the sucked air functions to directly cool the core block 14, and travels through the conduits 26, 53 and 27, 54 or 26*a*, 53*a* and 27*a*, 54*a* to the suction chamber 61 or 61*a* of the end wall cover 59 or 59*a*. When the actuator 15 has been displaced onto the side of, for example, the compression-chamber part 51, the compression chamber 12' is under a high pressure to pressurize the suction valve means 57 into its closed state so that the sucked air will not flow from the suction chamber 61 into the compression chamber 12', whereas the discharge valve means 56 is brought into its open state by the raised pressure in the compression chamber 12' so that air will be discharged through the discharge chamber 60 and conduits 55 and 30 out of the discharge port 29*a* to the exterior. In the displaced position of the actuator 15 onto the side of the compression-chamber member 51, further, the compression chamber 12' is in a low pressure state of keeping the discharge valve means 56*a* in its closed state, whereas the suction valve means 57*a* is turned into open state due to an overwhelming pressure on the side of the suction chamber 61*a* against that in the compression chamber 12*a'*, and air which has reached from the interior of the body 13 to the suction chamber 61*a* is caused to flow into the compression chamber 12*a'*.

When the actuator 15 is displaced onto the side of the other compression-chamber part 51*a*, an operation opposite to the above is performed, and air is caused to be discharged from the compression chamber 12*a'* through the discharge chamber 60*a*, conduits 55*a* and 30 to the exterior out of the discharge port 29*a*.

In the present instance, it should be appreciated that, as will be clear from the foregoing, the air suction and discharge are carried out through the air path elongated throughout the bottom, both ends and top portions of the housing for the pump 10, and not only the core block 14 but also the entire pump housing can be effectively smoothly cooled. As the suction and discharge ports 29 and 29*a* are located at the top face of the pump 10, that is, in the same face thereof to be mutually closer relationship, required work for coupling the pump 10 to any associated equipment is made easier, and even required arrangement on the side of the associated equipment for its coupling to the pump 10 can be made simpler.

What we claim as our invention is:

1. An electromagnetic air pump comprising:

a housing including a box-shaped body having upstanding side walls and a fully open top side for providing physical and visual access to an interior of said box to accommodate the assemblage of parts therewithin and visual inspection of the assembled parts, said parts including:

an electromagnetic core block mounted within said body interior and including an iron core and electric coils wound on said core to form an air gap which is centrally disposed in said interior and visible through said open top side, and an actuator including permanent magnet means, said actuator disposed in said air gap for being shiftable when electromagnetically excited by said core block, a cover member mounted over said open top side for covering said top side, with said parts assembled in said interior, two flexible diaphragm means mounted in respective ones of two of said side walls opposed to one another in the direction of shifting of said actuator, each of said diaphragm means being coupled to said actuator to be flexed thereby in response to shifting of said actuator, and means, including said diaphragm means, defining variable volume chambers within said housing and including suction and discharge valve means which are selectively opened and closed in response to volume variation of said chambers produced by flexing of said diaphragm means in order to create an air flow.

2. An air pump according to claim 1, wherein said two side walls extend higher than said diaphragm means.

3. An air pump according to claim 1, wherein said actuator comprises a pair of frame halves which are held in mutual engagement, said frame halves defining a plurality of recesses, said permanent magnet means comprising separate permanent magnets disposed in respective recesses.

4. An air pump according to claim 3, wherein mutually engaging faces of said frame halves include mutually engaging projections and recesses for securing said halves together.

5. An air pump according to claim 1, wherein each of said diaphragm means comprises flexible material having a separate coupling member attached at a center thereof, said separate coupling member connected to a respective end of said actuator.

6. An air pump according to claim 5, wherein said separate coupling member comprises a plate formed of resin containing metal powder.

7. An air pump according to claim 1, wherein said cover member includes air suction ports and air discharge ports.

8. An air pump according to claim 7, wherein said housing includes end wall portions extending exteriorly across said variable volume chambers, each end wall portion forming a suction chamber communicating with said suction port through the interior of said body and communicating with an associated variable volume chamber through said suction valve means, each end wall portion also forming a discharge chamber communicating with an associated variable volume chamber through said discharge valve means and communicating with said discharge port.

9. An air pump according to claim 8, wherein said cover member includes a first port for conducting air traveling from said suction port to the interior of said body and a second port for conducting air traveling from said discharge chamber to said discharge port.

10. An air pump according to claim 1, wherein each of said side walls includes a circular through-hole and a concentric circular groove formed in a surface of said side wall facing away from said body, each said diaphragm means disposed across a respective one of said holes and including an annular peripheral flange situated in said groove.

* * * * *

UNITED STATES PATENT AND TRADEMARK OFFICE

CERTIFICATE OF CORRECTION

PATENT NO. : 4,859,152

DATED : August 22, 1989

INVENTOR(S) : Rokusaburo Kimura; Yoshie Watari; Satoshi Makayama

It is certified that error appears in the above-identified patent and that said Letters Patent is hereby corrected as shown below:

Title page [75] Inventors, "Satoshi Makayama" should be --Satoshi Nakayama--.

Signed and Sealed this

Tenth Day of September, 1991

*Attest:*

*Attesting Officer*

HARRY F. MANBECK, JR.

*Commissioner of Patents and Trademarks*